US005289834A

United States Patent [19]

Lawrence

[11] Patent Number: 5,289,834

[45] Date of Patent: Mar. 1, 1994

[54] PONYTAIL TOOL

[76] Inventor: Lloyd D. Lawrence, 23667 Via Avant, Valencia, Calif. 91350

[21] Appl. No.: 10,854

[22] Filed: Jan. 29, 1993

[51] Int. Cl.[5] ..... A45D 7/02

[52] U.S. Cl. ..... 132/212; 132/273

[58] Field of Search ..... 132/61, 65.1, 66.1, 132/68.1, 69.1, 212, 273, 276; 119/153

[56] References Cited

U.S. PATENT DOCUMENTS

| | | | |
|---|---|---|---|
| 389,664 | 9/1888 | Myers | 119/153 |
| 1,146,934 | 7/1975 | Gleeson | 132/273 |
| 1,241,337 | 9/1917 | Breitenstein | 132/273 |
| 1,343,213 | 6/1920 | Johnson et al. | 119/153 |
| 1,476,895 | 12/1923 | Langenbacher | 119/153 |
| 1,892,262 | 12/1932 | Andrew | 132/273 |
| 2,582,339 | 1/1952 | Krueger | 119/153 |
| 3,099,271 | 7/1963 | Dubelier | 132/273 |
| 3,402,959 | 9/1968 | Harris | 119/153 |
| 4,667,860 | 5/1987 | Feuerman | 223/99 |
| 5,036,870 | 8/1991 | Edmark | 132/212 |
| 5,167,245 | 12/1992 | Harriett | 132/273 |

FOREIGN PATENT DOCUMENTS

| | | | |
|---|---|---|---|
| 1393317 | 2/1965 | France | 132/273 |

OTHER PUBLICATIONS

"Grooming to Win", Susan E. Harris, Howell Bookhouse, 1977, pp. 196–202.

*Primary Examiner*—Gene Mancene
*Assistant Examiner*—Frank A. LaViola
*Attorney, Agent, or Firm*—Jack C. Munro

[57] ABSTRACT

A tool for facilitating threading of a ponytail type of hair style within itself to achieve an attractive in appearance hair style. The tool includes a loop through which the ponytail is conducted with this loop to then be tightened on the ponytail prior to being pulled through the inner portion of the ponytail.

3 Claims, 1 Drawing Sheet

PONYTAIL TOOL

BACKGROUND OF THE INVENTION

1. Field of the Invention

The field of this invention relates to tools and more particularly to a tool which facilitates the achieving of a rather unique hair style which heretofore has been difficult to achieve without the use of any tool.

2. Description of the Prior Art

Hair styles have long been important to human beings. Women are the primary utilizers of hair styles. For a substantial number of years a desirable form of hair style is what is termed to be a ponytail. A ponytail condenses the hair rearwardly of the head of the user into a rope or cord-like strand with a banding means such as a rubber band being placed around the ponytail to maintain the hair in this position. Once the hair is in the position of a ponytail it can be wound up into a bun or altered to assume many other numerous configurations.

One of the configurations of a ponytail would be to take the outer portion of the ponytail and downwardly thread such through the inner portion of the ponytail (that portion of the ponytail which is located directly adjacent the head). However, for most people, this is difficult to do and usually requires a second person to assist in manipulating the hair in this manner.

However, a tool was constructed and patented in the U.S. Pat. No. 5,036,870 issued Aug. 6, 1991 which facilitated this threading of the outer portion of the ponytail through the inner portion of the ponytail. This tool comprised an elongated handle and a wire or plastic loop of a particular configuration attached to one end of the handle. This plastic loop was of a fixed size configuration. The disadvantage of this tool is that there was no way to compress the size of the loop to make it threadable through the hair in a easier manner. Additionally, because the ponytail was retained within the loop in a very loose manner, some individual hair strands might not get threaded through the hair which would result in a rather unattractive appearance generally requiring the threading procedure to be redone.

SUMMARY OF THE INVENTION

The primary objective of the present invention is to construct a tool which facilitates the achieving of a particular type of hair style and achieves that hair style more proficiently than was achieved with the tool of prior U.S. Pat. No. 5,036,870.

Another objective of the present invention is to construct a tool which operates simply and easily by even the most unskilled individual and which can be manufactured inexpensively and therefore sold to the ultimate consumer at an inexpensive price.

The tool of the present invention comprises an elongated slender body which has a through longitudinal opening. Conducted through this opening is a cord generally constructed of plastic with this cord forming a loop at the upper end of the body. At the lower end of the body, the cord is attached to a lever. This lever, when located directly adjacent and normally abuts the body, locates the loop in a position defining the largest area. The lever can be moved in a direction away from the body which will cause the loop to decrease its enclosed area with the smallest area defined by the loop when the lever is the furthest from the body.

DETAILED DESCRIPTION OF THE SHOWN EMBODIMENT

Figure 1:
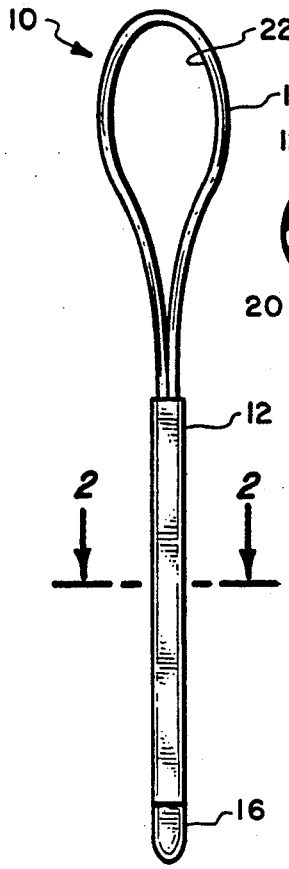
FIG. 1 is a front view of the tool of the present invention showing the loop in the position defining the largest area and the lever in a position abutting against the body.
Figure 2:
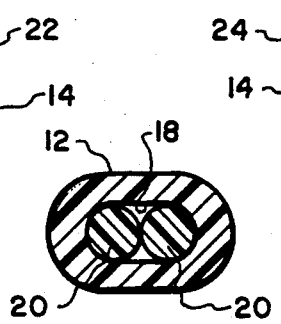
FIG. 2 is a cross sectional view through the body taken along line 2—2 of FIG. 1.

Referring particularly to the drawing there is shown the tool 10 of this invention which is composed generally of a body 12, a loop 14 and a lever 16. The body 12 is generally five to six inches in length and has an interior, longitudinal, through, open-ended opening 18. Within this opening 18 is mounted two strands located in a side-by-side manner of a cord 20. The ends of the strands 20 are fixedly secured to the lever 16. The strands 20 are continuous and extend from the upper end of the body 12 forming the loop 14.

Figure 3:
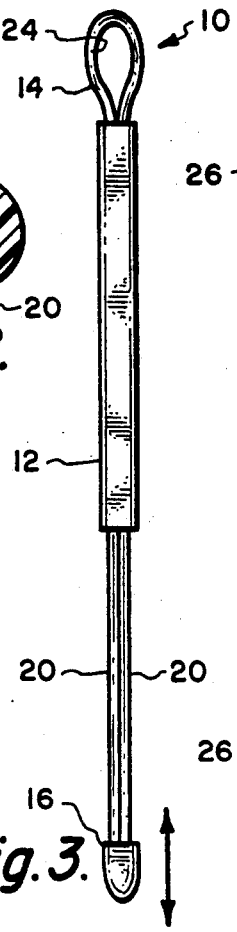
FIG. 3 is a view similar to FIG. 1 but showing the lever in a position spaced from the body and the loop defining an enclosed area substantially smaller than that of FIG. 1.

A user is able to hold the body 12 in one hand and with the other hand grasp a lever 16 and pull outwardly which will result in the lever 16 being moved from the inner position shown in FIG. 1 through a spaced position shown in FIG. 3. This movement is accomplished easily with the sliding movement of the cord 20 within the opening 18 being easily accomplished. With the lever 16 in the inner position as shown in FIG. 1, the loop 14 encloses the largest area 22. When the lever 16 is moved to its furthest outer spaced position from the body 12, loop 14 encloses the smallest area 24.

Normally, the body 12 and the lever 16 will be constructed of plastic. Although the cord 20 and the loop 14 is defined as a cord which possibly infers that it is some kind of fabric, generally, the cord 20 and the loop 14 will be constructed of a plastic material. However, it is considered to be within the scope of this invention that other materials other than plastic could be utilized such as a fabric type of rope or possibly even a metallic type of material resembling a cable.

Figure 4B:
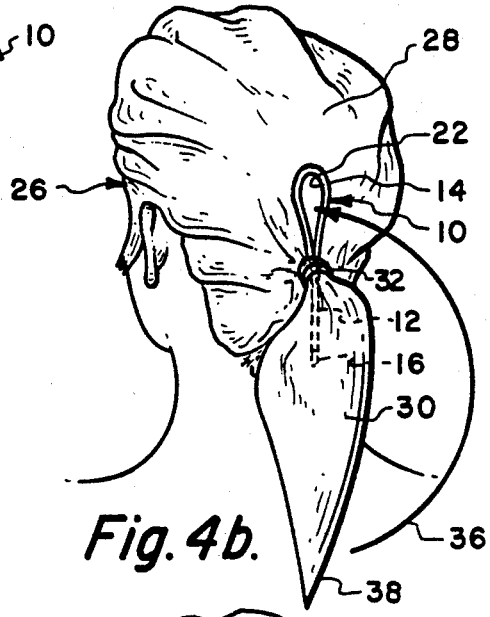
FIG. 4*b* shows the handle of the tool threaded through the inner portion of the ponytail and depicting moving of the outer portion of the ponytail through the largest area defined by the loop.
Figure 4C:
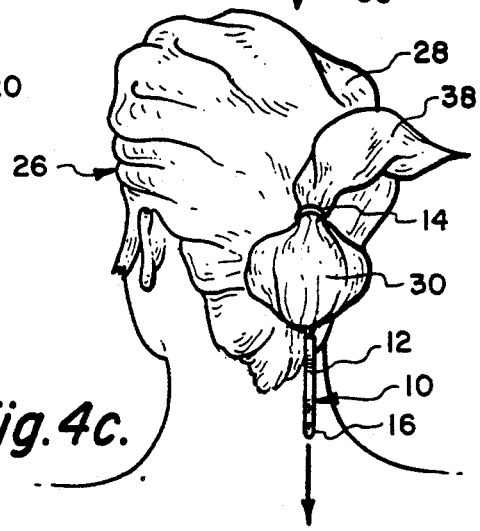
FIG. 4*c* shows the outer portion of the ponytail conducted through the largest area of the loop and now depicts moving of the lever to a spaced position which will tighten the loop onto the ponytail.
Figure 4A:
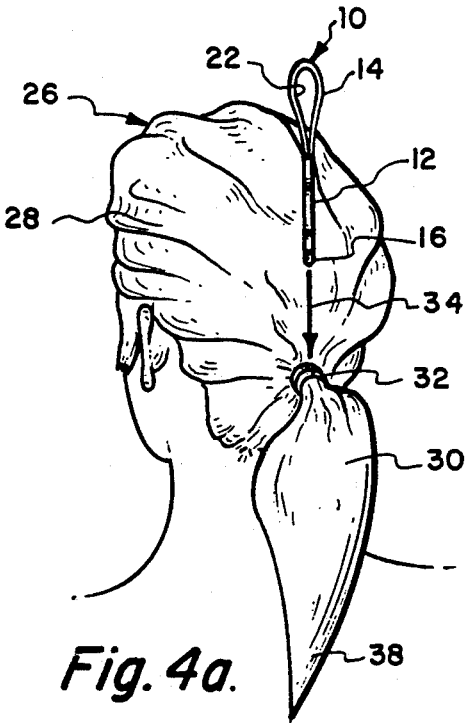
FIG. 4*a* shows initially the using of the tool of the present invention to connect with a ponytail type of hair style and the loop in the position defining the largest area.
Figure 4D:
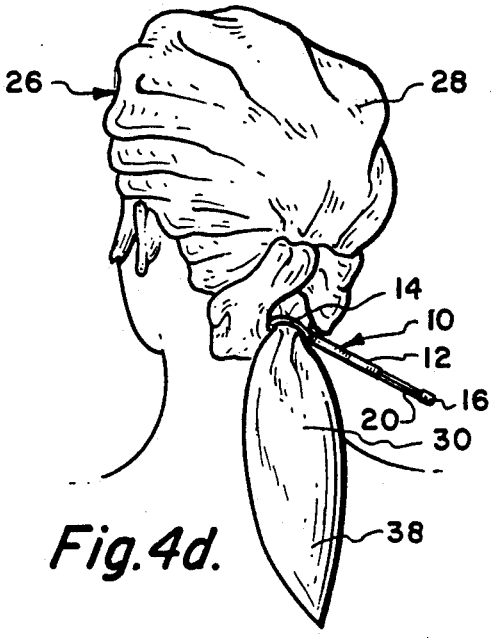
FIG. 4*d* shows the ponytail now threaded through itself and the tool still installed in conjunction with the ponytail but now in a position ready to be removed therefrom.

Possibly, the lever 16 could be pulled with sufficient force which would cause the loop 14 to become nonexistent and the cord 20 could be completely pulled through the opening 18 and be completely disassociated from the body 12. However, this would make the tool 10 completely ineffective and would not be a desirable thing to do by the user. Normally, the user would not move the lever 16 to any further position than is shown in FIG. 3 of the drawing. The user 26 manually manipulates the hair 28 to a rearwardly extending strand forming what is termed a ponytail 30. The user places a band 32, generally a rubber type of band, about the ponytail to maintain the ponytail 30 in its desired position. The user then takes the tool 10 of this invention and inserts the lever 16 and handle 12 through the upper portion of the ponytail adjacent the band 30 as is clearly shown in FIG. 4*a*. This insertion is depicted generally in the direction of arrow 34 with the body 12 and the lever 16 being threaded through the ponytail 30 with principally the body 12 and the lever 16 extending beneath the ponytail 30 and the loop 14 being located above the ponytail 30. To facilitate its insertion through the hair, to keep the hair from entangling the tool 10, it is to be noted from FIG. 1, that the lever 16 and body 12 combine to form a smoothly contoured continuous structure when the body 12 is located against the lever 16 which is defined as the inner position of the lever 16. As is shown in the drawing, the exterior cross-sectional configuration of the lever 16 is the same size and shape as the body 12. The user then proceeds to grasp the outer end of the ponytail and thread it through the largest area 22 defined by the loop 14 as is depicted by arrow 36 in FIG. 4*b*. Once this has occurred, the user then grasps the lever 16 and pulls outward essentially duplicating the position of FIG. 3. This tightens the loop 14 on the ponytail 30 and prevents any accidental disengagement of any strands of the hair from the tool 10. The user then grasps the body 12 and pulls it in a downward direction which causes the smaller dimensioned loop 14, as is shown in FIG. 3, to be threaded through the ponytail with the outer end 38 being threaded through the inner end of the ponytail forming a configuration as is shown in FIG. 4*d*. The user will then move the lever 16 back directly adjacent the body 12 which will position the loop 14 to enclose the largest area 22. The tool 10 can then be slid out of engagement with the ponytail 30 passed the outer end 38. The desired hair style has now been achieved.

It is to be understood that the tool 10 can be readily reused in exactly the same manner as previously described.

By tightening of the loop 14, all the hair in the ponytail 30 is clamped, regardless of length. This permits the user to obtain a more attractive hair style.

Women will loose approximately two hundred hairs each day. This is mainly due to brushing the hair as well as the aging process. The body system has a way of reproducing these two hundred hairs each day. In doing so the head will always have irregular lengths of hair throughout the ponytail 30. By tightening of the loop 14, all the hair in the ponytail 30 is clamped, regardless of length. This permits the user to obtain a more attractive hairstyle.

Many women have thin, fine hair. Fine hair is defined as having a much smaller diameter than coarse hair. A fine hair ponytail 30 is much smaller and harder to grasp than a ponytail of coarse hair.

The adjustable loop 14 makes the threading easier and better of a thin, fine hair ponytail 30 through itself since the loop 14 is tightly secured onto the hair.

What is claimed is:

1. A ponytail tool comprising:

an elongated body having a through interior open-ended opening, said body adapted to be manually grasped by the user, said body terminating at an upper end and a lower end;

a cord being conducted through said opening, said cord extending exteriorly of said upper end and said lower end, said cord being formed into a loop at said upper end; and a lever attached to a lower end of said cord, said lever being located adjacent said lower end of said body, said lever having a generally pointed tip to facilitate insertion into the hair and said lever being manually movable between an inner position and an outer position, said inner position being when said lever is located directly adjacent said body, said lever and said body combining at said inner position to form a smoothly contoured continuous structure, said outer position being when said lever is spaced from said body, with said lever in said inner position said loop enclosing the largest area, with said lever in said outer position said loop enclosing an area smaller than said largest area, said lever and said body are to be conducted through a hair ponytail with enlargement between the hair and said cord being prevented by said lever and said body assuming said smoothly contoured configuration and then the ponytail can be threaded through itself by locating the outer portion of the ponytail through said loop within said largest area and said lever then being moved to said outer position tightening said loop on said ponytail which is then pulled through the inner portion of the ponytail.

2. The ponytail tool as defined in claim 1 wherein:

said body being substantially longer than said lever.

3. The ponytail tool as defined in claim 2 wherein:

said lever being of the same cross-sectional size as said body.

* * * * *